United States Patent [19]

Baus

[11] Patent Number: 4,802,294

[45] Date of Patent: Feb. 7, 1989

[54] FRAME, MORE PARTICULARLY FOR A PICTURE

[76] Inventor: Heinz G. Baus, Wartbodenstrasse 35, CH-3626 Hünbach-Thun, Switzerland

[21] Appl. No.: 45,565

[22] Filed: May 4, 1987

[30] Foreign Application Priority Data

May 3, 1986 [DE] Fed. Rep. of Germany ..... 3615117

[51] Int. Cl.[4] ..... A47G 1/06

[52] U.S. Cl. ..... 40/155; 40/156; 403/295

[58] Field of Search ..... 40/155, 156, 152; 403/295, 401, 402

[56] References Cited

U.S. PATENT DOCUMENTS

| | | | |
|---|---|---|---|
| 3,294,430 | 12/1966 | Halip | 403/295 |
| 3,351,367 | 11/1967 | Beckman | 403/295 |
| 3,673,674 | 7/1972 | Catulle | 403/401 |
| 3,848,390 | 11/1974 | Anderson et al. | 403/401 |
| 3,899,844 | 8/1975 | Munn | 40/156 |
| 4,348,826 | 9/1982 | Reim | 40/156 |
| 4,635,579 | 1/1987 | Marker et al. | 403/295 |

FOREIGN PATENT DOCUMENTS

| | | | |
|---|---|---|---|
| 2647884 | 4/1978 | Fed. Rep. of Germany | 40/155 |
| 7633157 | 6/1979 | Fed. Rep. of Germany . | |
| 2831910 | 2/1980 | Fed. Rep. of Germany . | |
| 3027258 | 3/1981 | Fed. Rep. of Germany . | |
| 2942555 | 4/1982 | Fed. Rep. of Germany . | |
| 2160512 | 6/1973 | France . | |
| 2322572 | 4/1977 | France . | |
| 2331809 | 6/1977 | France . | |

*Primary Examiner*—Robert P. Swiatek
*Assistant Examiner*—Cary E. Stone
*Attorney, Agent, or Firm*—Foley & Lardner, Schwartz, Jeffery, Schwaab, Mack, Blumenthal & Evans

[57] ABSTRACT

A frame, more particularly for a picture, comprises profiled rails which are joined together at the corners of the frame by a corner-connector. Each corner-connector comprises two plugs arranged respectively in a cavity in each profiled rail, and each of the cavities comprises an opening extending in the longitudinal direction. The object to be achieved is a functionally reliable joint between the profiled rails which is simple to produce and can easily be released when required. To this end, each plug comprises a tongue which passes through the opening in the cavity and which engages, by means of a hook element or the like, behind a retaining element. A retaining element of this kind is arranged on at least one web of the profiled rail.

21 Claims, 2 Drawing Sheets

FRAME, MORE PARTICULARLY FOR A PICTURE

BACKGROUND OF THE INVENTION

1. Field of the invention

The present invention relates to a frame, more particularly for a picture.

In particular, the present invention relates to a frame of the type having profiled rails joined together at the corners of the frame, by means of corner-connectors, each of the profiled rails comprising a cavity, an opening extending in the longitudinal direction, and a web, and each corner-connector comprising two plugs inserted into the cavity in the respective profiled rail.

2. Description of the Prior Art

French patent application No. 23 22 572 discloses a frame of this kind which is intended to accommodate a painting, a reproduction, a photograph or some other work of art. The profiled rails contain a cavity of approximately rectangular cross-section comprising an opening which extends in the longitudinal direction of each rail between two webs. The latter are provided, in the vicinity of the corner of the frame, with a recess in which the corner-connector engages by means of a hook arranged at the free end of the plug. Like the plug, the hook is located in the interior of the cavity, the tip of the hook being directed outwardly out of the cavity. When the profiled rails are united to form a frame, difficulties may arise if the hook fails to engage correctly in the recess in the web. Proper seating of the corner-connectors cannot readily be checked since the plugs and hooks are located in the cavity and are accessible only through the opening. During assembly, there is a danger of the hook being inadvertently pressed into the cavity and of the joint being released.

German OS No. 30 27 258 discloses a frame which allows the picture to be replaced, the frame comprising a corner-connector having a tongue with a hook outside the cavity. The plug is arranged in the cavity. The profiled rail comprises a recess in which the hook of the tongue engages from the outside. Since the tongue has no protection against outside influences, inadvertent release of the joint cannot be excluded. A great amount of material is required for the corner-connector and there is a danger that the exposed tongues may be torn off in practice.

German GM No. 76 33 157 discloses a frame, which allows the picture to be replaced, in which the corner-connectors each have a plug and a hook on a flexible tongue in the cavity. From the interior of the cavity, the hook engages in a recess in the profiled rail. Correct seating of the hook cannot readily be checked during assembly. Furthermore, it is not impossible for the hook to be pressed in inadvertently when the picture is being hung, thus releasing the joint between the profiled rails.

Finally, German patent 29 42 555 discloses a frame, which allows the picture to be replaced, in which the corner-connector in the cavity in the respective profiled rail comprises a tongue. The tongue has a free front-face facing the corner of the frame. On each side of the tongue the corner-connector contains narrow attachment webs which means that the plug is relatively wide. Furthermore, proper seating of the tongue cannot readily be checked and the joint may be released by inadvertently pressing the tongue into the cavity.

OBJECTS OF THE INVENTION

It is the purpose of the invention to propose a frame of the kind mentioned above in such a manner that, on the one hand, a reliable joint is obtained and, on the other hand, the joint can readily be checked. Inadvertent release of the joint while it is being held in the vicinity of the corner is to be prevented, and it should also be possible to release the joint, when required, without any additional tools. The corner-connector is to ensure, with a minimal amount of material, a functionally reliable joint which may easily be released again when required.

SUMMARY OF THE INVENTION

According to the present invention, there is provided a frame, particularly for a picture, comprising profiled rails joined together at the corners of the frame by means of corner-connectors, each of the rails comprising a cavity and two webs extending in the longitudinal direction of the rail, and an opening between the two webs also extending in the longitudinal direction of the rail, each of the corner-connectors comprising two plugs, each plug being inserted from an end inside the cavity of a rail, at least one of the webs comprising a retaining element projecting beyond the outer surface of the at least one web, each plug comprising in the vicinity of the retaining element a tongue which extends outwardly from the cavity through the opening, this tongue having a width which is at the most equal to the width of the opening and a free end, at least a hook element being provided at the free end of the tongue, the hook element extending outside the cavity above the outer surface of said at least one web, and means for locking the hook element to the retaining element.

Preferably, the retaining element is arranged at an angle to the outer surface of said at least one web, the retaining element being obtained by an stamping out or bending outwardly of the web.

Two hook elements may be provided at the free end of the tongue, one at each lateral side of the tongue, the tongue being resilient, and in such case each of the two webs may be provided with a retaining element, each being engaged with one hook element.

The hook elements can be engaged under preload with a corresponding retaining element provided respectively on each of the two webs.

Preferably, the retaining element may comprise a first engaging surface remote from a corner, against which a second engaging surface on the tongue and the hook elements bears.

The above first and second engaging surfaces are preferably arranged at an angle to the outer surfaces of the webs so that the tongue is urged towards the outer surfaces of the webs by the resulting wedging action.

The free end of the tongue may be provided with a nose adapted to be lifted by hand for disengaging the hook elements from the retaining elements thus permitting the removal of the plugs from said rails.

Preferably, the tongue extends from a free end of each plug, the tongue being corrugated for providing resilience thereto, or it may be made of a resilient material.

Preferably, each rail may comprise extensions directed towards a rear edge of the frame, the webs being so located with respect to the rear edge and the extensions having such a predetermined height that the tongue, the nose and the hook elements are prevented from projecting beyond the rear edge of the frame.

Each profiled rail may comprise on a front side opposite to the rear side of the frame containing the rear edge a leg directed toward to the center of the frame, against which a picture is pressed.

A carrier and a sheet of glass may sandwich the picture.

Preferably, the frame further comprises a spring-element adapted to press the picture sandwiched or not between the carrier and the sheet of glass against the leg.

Preferably, the spring element comprises a hook and each of the profiled rails comprises an L-shaped extension in which the hook of the spring element engages from a side opposite the rear edge of the frame, the spring element preferably further comprises a base part, connected by an arc to said L-shaped extension, the base part bearing against the carrier.

Preferably, means such as a force directed from the cavity towards the rear edge of the frame act upon the tongue when the retaining elements are pushed over, and when the retaining elements have been pushed over, the tongue which is resilient, along with the hook elements, is moved towards the cavity and engages the retaining elements.

The frame according to the invention is of functionally reliable design and ensures a reliable joint between the profiled rails at the corners of the frame. No special tools are required to make the joint. Instead, the tongue can be released manually from the retaining element, whereupon the retaining element may be removed from the cavity in the longitudinal direction thereof.

The tongue of the respective plug passes through the opening extending in the longitudinal direction of the cavity and, for the purpose of making the joint, it can easily be pushed over the retaining element on the web of the profiled rail after which it is reliably engaged with the hook. As indicated above, the tongue is secured to the plug, sufficient movement is provided to ensure its mobility in connection with the retaining element.

As indicated above, when the retaining element is pushed over, the tongue is moved, by means of a force directed away from the cavity, towards the rear side of the profiled rail. After the retaining element has been pushed over, the tongue snaps back towards the cavity, thus ensuring reliable locking.

As indicated above, the tongue preferably comprises a nose under which a finger engages in a simple manner, to allow the joint to be released quite easily when required. The tongue needs only be raised, against the action of the spring, over the retaining elements, whereupon the tongue and the whole corner-connector can be withdrawn from the end of the profiled rail The resilient configuration at least of the tongue and also of the corner-connector as a whole, ensures reliable bracing of the two profiled rails in the corner areas. The mitred profiled rails therefore fit well together in the corner areas, leaving no unwanted gaps to be seen. Local overstressing and associated deformation of the profiled rails, as when screwed elements are used, is eliminated.

Preferably, the corner-connectors are preferably made of plastic.

The suitable predetermination of the thickness of the material and the length of the tongue make it a simple matter to achieve mobility. This mobility may also be quite easily ensured by using a metal with adequate resilient yield. The tongue may be made resilient, either because of its shape or because it is made of a suitable material.

BRIEF DESCRIPTION OF THE DRAWINGS

Preferred embodiments of the present invention are described hereinafter in greater detail, as examples without limitative manner, in conjunction with the attached drawings, wherein.

DESCRIPTION OF AN EXEMPLARY EMBODIMENT

Figure 1:
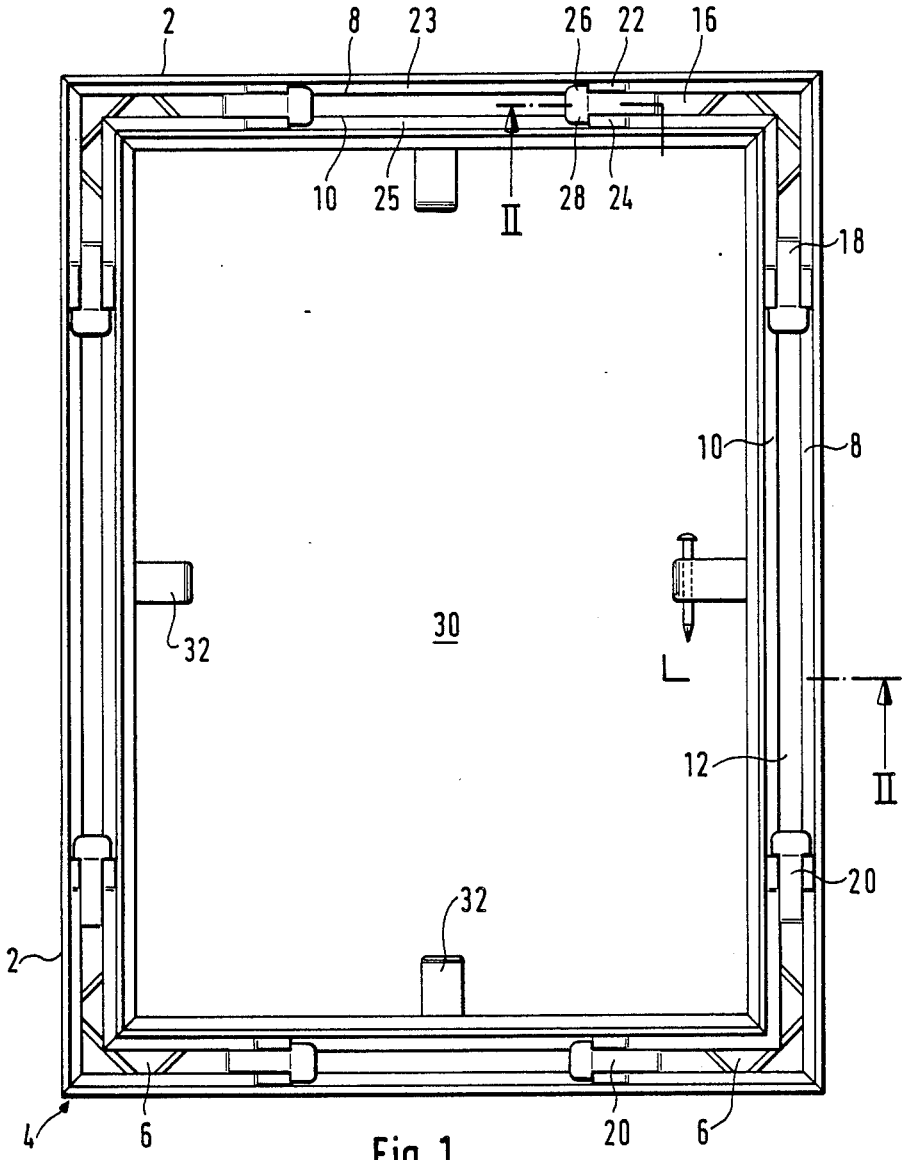
FIG. 1 is a view of the rear side of the picture-frame.

FIG. 1 is a view of the rear side of the frame which consists of four profiled rails 2. Each of the rails is mitred at corners 4, a corner-connector 6 being arranged in the profiled rails in each corner. The rails 2 carry, on their rear sides, two webs 8,10 running parallel with each other in the longitudinal direction, between which is located an opening 12 which also extends in the longitudinal direction. Located under webs 8,10 of profiled rail 2 is a cavity 14 into which are inserted, from the ends, plugs 16, 18 of the corner-connector 6 which are at right angles to each other. Corner-connectors 6 also comprises, at plugs 16, 18, tongues 20 each of which engages behind a retaining element 22, 24 on webs 8, 10. The retaining elements 22, 24 project, to some extent, beyond webs 8, 10, so that tongues 20 may be pushed over them and may engage behind lateral hook elements, such as hooks 26,28. It should be noted that tongue 20 with hooks 26,28 extends from the respective end of profiled rail 2 beyond retaining elements 22,24.

Inserted into the frame is a carrier 30 for a picture 50 which can be observed from the front of the frame. The carrier 30, the picture 50 and, if necessary, a sheet of glass 52 are held in the frame by means of spring-elements 32.

Figure 2:
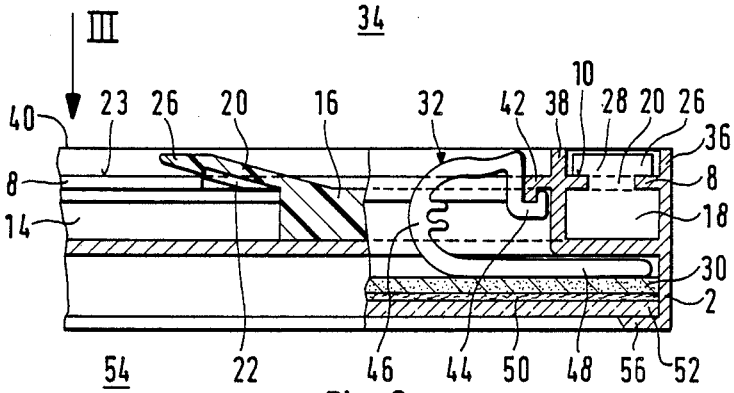
FIG. 2 is a section along the line II in FIG. 1, to an enlarged scale.

FIG. 2 is, to an enlarged scale, a section along line II in FIG. 1 showing web 8 and cavity 14 lying under or in front of the web 8. Located in cavity 14 are the corner-connector and plug 16 at the end of which tongue 20 is arranged. The tongues 20 passes through the above-mentioned opening 12 between the webs 8,10, and a hook element such as a hook 26 may be seen here at the front end. This, and the other hook element or hook 28, engages behind retaining element 22 of web 8. The retaining element is made quite simply by stamping out and bending upwardly and towards rear side 34.

Like the other retaining element 24 located in front of the plane of the drawing, retaining element 22, here visible, projects outwardly beyond outer surface 23 of web 8. Tongue 20 passes outwardly from cavity 14 between the two retaining elements 22,24, so that the free end of tongue 20, with its two hooks 26,28, is located above outer surfaces 23,25. The engaging surfaces of the hooks 26,28 engage behind the retaining elements 22,24 outside cavity 14 and above the outer surfaces 23,25 of the two webs 8,10. The two hooks 26,28 are arranged laterally at the front end of the tongue 20. Then the joint is being made, the hooks 26,28 slide first of all over the webs 8,10 and the retaining elements 22,24, the free end of the tongue 20 carrying out a movement away from the outer surfaces 23,25 of the webs 8,10. As soon as the hooks 26,28 reach the end of the retaining element 22,24, a force acting in the direction of outer surfaces 23,25 of the web 8,10 can bring the hooks 26,28 into engagement with the retaining elements 22,24, thus locating the joint. If, as a result of manufacturing tolerances, the hooks 26,28 do not automatically snap in, it is a simple matter to apply finger-pressure to the hooks 26,28 from the outside in order to make the joint. Thereafter there is no danger of releasing the joint by grasping the frame, since this would press the hooks 26,28 against the outer surface 23,25 of the webs 8,10. In order to release the joint, a force directed away from outer surface 23,25 must be applied, in order to push the hooks 26,28 over the retaining elements 22,24.

Visible in the right-hand part of FIG. 2 is a front elevation of the other plug 18 and lateral hooks 26,28 thereof. Profiled rail 2 comprises two extensions 36,38 directed towards rear side 34, between which is located tongue 20 with its hooks. Webs 8,10 and the height of extensions 36,38 are predetermined so that the tongue 20, with hooks 26,28, is located within the profiled rail 2 and does not project beyond rear edge 40.

Profiled rail 2 also comprises, towards the middle, an L-shaped extension 42 which anchors spring-element 32. The latter engages, with a hook 44, behind the L-shaped extension and passes, round an arc 46, into a base part 48 which bears against the rear side of the carrier 30. The carrier 30, a picture 50 and a sheet of glass 52 are inserted into the resulting frame. To this end, front side 54 of profiled rails 2 comprise a leg 56 against which the front side of sheet 52 of glass bears, as shown. Carrier 30, picture 50 and sheet 52 of glass are pressed against leg 56 by spring-element 32.

The fitting or replacing of a picture requires only a few operations, since only one profiled rail need be removed from one side of the frame. According to the invention, this is a simple matter involving raising nose 58 on tongue 20 with hooks 26,28, over the retaining elements 22,24 of the webs 8,10, after which removing the plugs 16,18 from the profiled rail 2 presents no problems. Nor are any tools required. The frame may be put together again by reversing the sequence of operations and inserting the plug into the cavity from the end. At this time, hooks 26,28 slide over retaining elements 22,24 and engage behind them.

Figure 3:
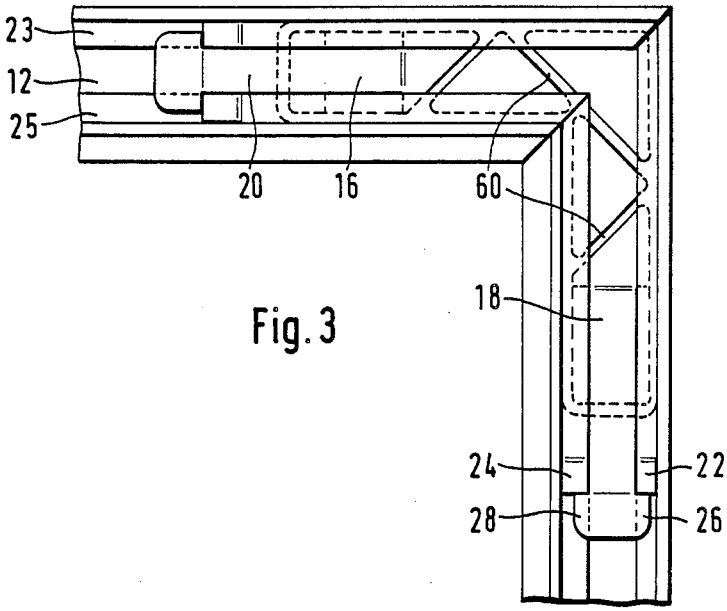
FIG. 3 is a view in direction III of FIG. 2.

FIG. 3 is a view in the direction of arrow III in FIG. 2. Tongues 20, with lateral hooks 26,28, extended forwardly, are easily visible here. The corner-connector 6, and plugs 16,18 thereof, carry, on the rear side, ribs 60 providing stiffening. The ribs 60 also permit a certain amount of compensation for tolerances. The corner-connectors are made of a plastic having sufficient elasticity. The plugs may be made slightly oversize since ribs 60, upon being inserted into the cavities, are compressed to a certain extent, so that only a small amount of force is needed to push them in.

Figure 4:
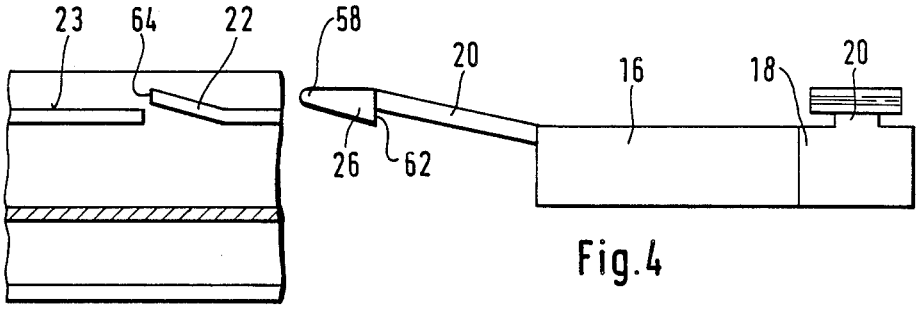
FIG. 4 shows another embodiment of the corner-connector, to an enlarged scale.

FIG. 4 illustrates an embodiment in which tongue 20 is corrugated in the longitudinal direction. This improves greatly the spring-action of the tongue, thus ensuring a reliable joint. Production tolerances, especially when retaining elements 22 are fitted into the webs, may thus easily be compensated for and, at the same time, a functionally reliable joint is ensured. Furthermore, the oblique setting of engaging surfaces 62,64 of tongue 20 and retaining elements 22 provides a wedging action whereby the tongue, after engagement of retaining element 22, remains reliably anchored in this position. Undesired release of hooks 26 from retaining elements 22 is prevented at low cost.

I claim:

1. A frame for a picture comprising:

profiled rails joined together at the corners of the frame by means of corner-connectors, each of said rails comprising a cavity and two webs extending in the longitudinal direction of the rail, and said two webs having an opening between them also extending in the longitudinal direction of the rail, said cavity being formed from a substantially U-formed portion of the profiled rail comprising of rearwardly directed legs each carrying one of said two webs, each web projecting laterally toward the web carried by the other leg , each of said corner-connectors comprising two plugs formed integrally with each other in a single piece, each plug being inserted from an end inside the cavity of a rail, at least one of the webs comprising a retaining element projecting rearwardly behind the rear surface of said at lest one web, each plug comprising in the vicinity of said retaining element a resilient tongue with a free end which extends outwardly from the cavity through the opening between said two webs, said tongue being formed integrally with the plug and having a width which is at the most equal to the width of said opening, at least one laterally projecting hook element being provided at said free end of the tongue, said hook element extending outside said cavity and overlying said rear surface of said at least one web, said tongues and lateral hook elements having a maximum width no wider than the width of said plugs, and means for locking said hook element to said retaining element.

2. A frame according to claim 1, wherein said retaining element is arranged at an angle to said rear surface of said at least one web, said retaining element being obtained by stamping out and rearwardly bending a portion of the web.

3. A frame according to claim 2, wherein two hook elements are provided at the free end of said tongue, one at each lateral side of the tongue, each hook element being engaged under spring bias with a corresponding retaining element provided respectively on each of said two webs.

4. A frame according to claim 2, wherein said retaining element comprises a first engaging surface remote from a corner of the frame, against which a second engaging surface on the tongue and the hook elements bears.

5. A frame according to claim 1, wherein said profiled rails are joined together at right angles.

6. A frame according to claim I wherein said corner-connectors are resilient.

7. A frame according to claim 6, wherein said corner-connectors are made of plastic.

8. A frame according to claim I, wherein the leg of profiled rail (2) located at the outer margin of the frame carries an L-shaped leg (56) extending forwardly and laterally toward the Center of the frame, said cavity (14) and said corner connectors comprising the plugs (16, 18) are arranged behind the outer edge of a member (52) enclosed by the frame, and the outer margin said enclosed member (52) is overlapped in front only by the laterally extending portion of the L-shaped leg (56).

9. A frame according to claim 1, further comprising a spring element (32) arranged adjacent said cavity (14) extending toward the center of the frame and having a curved resilient central portion (46) and a hook element (44) at one end which engages an L-shaped extension on the leg of profiled rail (2) located at the inner margin of the frame, and said spring element further having a base part (48) at its other end extending forwardly and outwardly along the back of a member enclosed by said frame to a position in front of said cavity.

10. A frame according to claim 1, wherein each of said two webs has a retaining element formed thereon, said tongue carrying two laterally extending hook elements 26, 28 which overlie said two webs, and each of said hook elements engages a respective one of said retaining elements.

11. A frame according to claim 1, further comprising rearwardly directed extensions carried on said legs, said extensions projecting rearwardly of said tongue and hook elements to prevent said tongue and hook elements from sticking out behind the frame.

12. A frame comprising a plurality of profiled rails joined together by corner connectors to form corners of the frame, each of said rails comprising a cavity and two webs extending in the longitudinal direction of the rail, said two webs defining between them an opening also extending in the longitudinal direction f the rail, each of said corner-connectors comprising two plugs, each plug being inserted from an end inside the cavity of a rail, at least one of the webs comprising a retaining element projecting rearwardly behind the rear surface of said at least one web, each plug comprising in the vicinity of said retaining element a resilient tongue with a free end which extends outwardly from the cavity through said opening, said tongue having a width which is at the most equal to the width of said opening, at least one hook element extending outside said cavity behind said rear surface of said at least one web, and means for locking said hook element to said retaining element, said retaining element being arranged at an angle to said rear surface of said at least one web and being obtained by stamping out and rearwardly bending a portion of the web, said retaining element comprising a first engaging surface remote from a corner against which a second engaging surface on the tongue and the hook elements bears, and wherein said first and second engaging surfaces are arranged at an angle to the outer surfaces of the webs so that said tongue is urged towards said outer surfaces of the webs by the resulting wedging action.

13. A frame according to claim 12, wherein said free end of the tongue is provided with a nose adapted to be lifted by hand for disengaging said hook elements from said retaining elements thus permitting the removal of said plugs from said rails.

14. A frame according to claim 13, wherein said tongue extends from a free end of each plug, said tongue being corrugated for providing resilience thereto.

15. A frame according to claim 14, wherein each rail comprises extensions directed towards a rear edge of the frame, said webs being so located with respect to said rear edge and said extensions having such a predetermined height that said tongue, said nose and said hook elements are prevented from projecting beyond said rear edge of the frame.

16. A frame according to claim 15, wherein each profiled rail comprises on a front side opposite to the rear side of the frame containing said rear edge, a leg directed toward to the center of the frame, against which a picture is pressed.

17. A frame according to claim 16, further comprising a carrier and a sheet of glass sandwiching said picture.

18. A frame according to claim 16, further comprising a spring-element adapted to press said picture sandwiched between said carrier and said sheet of glass against said leg.

19. A frame according to claim 18, wherein said spring element comprises a hook and each of said profiled rails comprises an L-shaped extension in which said hook of said spring element engages from as side opposite said rear edge of the frame, said spring element further comprising a base part connected by a curved portion to said L-shaped extension, said base part bearing against said carrier.

20. A frame according to claim 15, wherein means directed from said cavity towards said rear edge of the frame act upon said tongue when said hook elements are pushed over said retaining elements, and wherein when said hook elements have been pushed over said retaining elements, the resilient tongue along with the hook elements, is moved towards said cavity and engages said retaining elements.

21. A frame according to claim 12, wherein two hook elements are provided at the free end of said tongue, one on each lateral side of said tongue, each of said two webs having a retaining element formed thereon, and wherein each of said retaining elements is engaged with a respective one of said hook elements.

* * * * *